US005269974A

United States Patent [19]

Ofosu-Asante

[11] Patent Number: 5,269,974

[45] Date of Patent: Dec. 14, 1993

[54] LIQUID OR GEL DISHWASHING DETERGENT COMPOSITION CONTAINING ALKYL AMPHOCARBOXYLIC ACID AND MAGNESIUM OR CALCIUM IONS

[75] Inventor: Kofi Ofosu-Asante, Cincinnati, Ohio

[73] Assignee: The Procter & Gamble Company, Cincinnati, Ohio

[21] Appl. No.: 938,979

[22] Filed: Sep. 1, 1992

[51] Int. Cl.[5] ..... C11D 3/32; C11D 17/00

[52] U.S. Cl. ..... 252/544; 252/548

[58] Field of Search ..... 252/544, 545, 548

[56] References Cited

U.S. PATENT DOCUMENTS

| | | | |
|---|---|---|---|
| 2,437,253 | 3/1948 | Henderson et al. | 252/109 |
| 2,438,091 | 3/1948 | Lynch | 260/482 |
| 2,528,378 | 10/1950 | Mannheimer | 260/309.6 |
| 3,849,347 | 11/1974 | Tokiwa et al. | 252/544 X |
| 4,061,602 | 12/1977 | Oberstar et al. | 252/547 |
| 4,098,818 | 7/1978 | Krummel et al. | 260/535 |
| 4,099,912 | 7/1978 | Ehrlich | 8/137 |
| 4,133,779 | 1/1979 | Hellyer et al. | 252/547 |
| 4,182,900 | 1/1980 | Crutchfield et al. | 560/180 |
| 4,220,548 | 9/1980 | Hashimoto et al. | 252/106 |
| 4,253,842 | 3/1981 | Ehrlich | 8/137 |
| 4,292,212 | 9/1981 | Melby | 252/547 |
| 4,435,317 | 3/1984 | Gerritsen et al. | 252/547 |
| 4,615,819 | 10/1986 | Leng et al. | 252/544 X |
| 4,671,894 | 6/1987 | Lamb et al. | 252/548 X |
| 4,681,704 | 7/1987 | Bernardino et al. | 252/546 |
| 4,704,233 | 11/1987 | Hartman et al. | 252/527 |
| 4,891,159 | 1/1990 | Nadolsky | 252/545 |
| 4,917,823 | 4/1990 | Maile, Jr. | 252/548 |
| 4,952,559 | 8/1990 | Login et al. | 512/10 |
| 4,978,781 | 12/1990 | Nadolsky | 562/102 |
| 5,009,814 | 4/1991 | Kelkenberg et al. | 252/548 |
| 5,013,485 | 5/1991 | Tsukuda et al. | 252/551 |
| 5,093,031 | 3/1992 | Login et al. | 252/357 |

FOREIGN PATENT DOCUMENTS

| | | |
|---|---|---|
| WO92/06171 | 4/1991 | PCT Int'l Appl. . |
| 1508929 | 4/1978 | United Kingdom . |
| 1523491 | 9/1978 | United Kingdom . |

OTHER PUBLICATIONS

Technical and Product Development Data, Miranol Inc., South Brunswick (Dayton), N.J. 08810, Miranol Products for Cosmetics & Toiletries (1992).

Copending U.S. patent application Ser. No. 07/819,559, Ofosu-Asante, filed Jan. 13, 1992.

Copending U.S. patent application Ser. No. 07/839,738, Cripe et al, filed Feb. 10, 1992.

Copending U.S. patent application Ser. No. 07/755,900, Ofosu-Asante et al, filed Sep. 6, 1991.

Copending U.S. patent application Ser. No. 07/938,978, Ofosu-Asante, filed Sep. 1, 1992.

Copending U.S. patent application Ser. No. 07/938,976, Ofosu-Asante, filed Sep. 1, 1992.

*Primary Examiner*—Arthur C. Prescott

*Attorney, Agent, or Firm*—Mary P. McMahon

[57] ABSTRACT

Liquid or gel dishwashing detergent compositions containing alkyl amphocarboxylic acid and magnesium or calcium ions for improved stability, sudsing and grease cleaning are described. Stable liquid detergent compositions containing alkyl amphodicarboxylic acid, and magnesium ions are preferred.

20 Claims, No Drawings

LIQUID OR GEL DISHWASHING DETERGENT COMPOSITION CONTAINING ALKYL AMPHOCARBOXYLIC ACID AND MAGNESIUM OR CALCIUM IONS

TECHNICAL FIELD

The present invention relates to liquid or gel dishwashing detergent compositions containing alkyl amphocarboxylic acid and magnesium or calcium ions.

BACKGROUND OF THE INVENTION

Liquid or gel dishwashing detergents with good grease removal benefits are much desired by consumers. Calcium and magnesium ions have been added to certain liquid or gel detergent compositions to improve grease cleaning benefits. However, it may be necessary to limit the pH and/or add chelating agents to stabilize these compositions. Ampholytic surfactants (amphoteric surfactants) in a dishwashing detergent composition provide mildness to the composition by mitigating the harshness of anionic surfactants.

It has been found that magnesium or calcium ions when added to a liquid or gel detergent composition containing certain alkyl amphocarboxylic acids surprisingly improves the stability, grease cleaning and sudsing of the composition at mildly alkaline pH (i.e., pH 7–10).

SUMMARY OF THE INVENTION

A liquid or gel dishwashing detergent composition comprising, by weight:

(a) from about 5% to about 95% of an alkyl amphocarboxylic acid of the general formula:

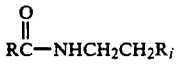

wherein R is a $C_8$–$C_{18}$ alkyl group, and $R_i$ is of the general formula:

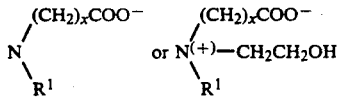

wherein $R^1$ is a $(CH_2)_xCOOM$ or $CH_2CH_2OH$, and x is 1 or 2 and M is a cation;

(b) from about 0.1% to about 4% of magnesium or calcium ions; and (c) from about 40% to about 55% water; wherein a 10% said composition has a pH in a 10% solution in water at 20° C. of between from about 7 and about 10.

A particularly preferred embodiment also comprises from about 5% to about 95% of a co-surfactant selected from the group consisting of anionic surfactant, nonionic surfactant, cationic surfactant, ampholytic surfactant, zwitterionic surfactant and mixtures thereof, and less than about 10% of suds booster.

DETAILED DESCRIPTION OF THE INVENTION

The liquid or gel, preferably liquid, dishwashing detergent compositions of the present invention contain an alkyl amphocarboxylic acid, preferably an alkyl amphodicarboxylic acid, and a source of magnesium or calcium, preferably magnesium, ions. The compositions herein may also contain a co-surfactant, preferably anionic surfactant, and suds booster. These and other complementary optional ingredients typically found in liquid or gel dishwashing compositions are set forth below.

The term "light duty dishwashing detergent composition" as used herein refers to those compositions which are employed in manual (i.e. hand) dishwashing.

Alkyl Amphodicarboxylic Acid

The liquid or gel compositions of this invention contain from about 5% to 95% by weight of the composition, of an alkyl amphocarboxylic acid. Liquid compositions herein preferably contain from about 5% to 60%, most preferably from about 5% to 35% by weight of the composition, of an alkyl amphocarboxylic acid. Gel compositions of this invention preferably contain from about 5% to about 70%, preferably from about 10% to about 45%, most preferably from about 12% to about 35% by weight of the composition, of an alkyl amphodicarboxylic acid.

The alkyl amphocarboxylic acid is of the generic formula

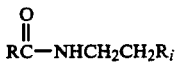

wherein R is a $C_8$–$C_{18}$ alkyl group, and $R_i$ is of the general formula

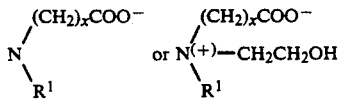

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium, and mixtures thereof with magnesium ions. The preferred R alkyl chain length is a $C_{10}$ to $C_{14}$ alkyl group.

In a preferred embodiment, the amphocarboxylic acid is an amphodicarboxylic acid produced from fatty imidazolines wherein the dicarboxylic acid functionality of the amphodicarboxylic acid is diacetic acid and/or dipropionic acid. A suitable example of an alkyl amphodicarboxylic acid for use herein is the amphoteric surfactant Miranol® C2M Conc. manufactured by Miranol, Inc., Dayton, N.J., having the general formula

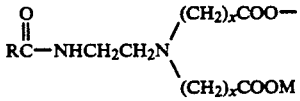

wherein R is a $C_8$ to $C_{18}$ alkyl group, and x is 1 or 2, and M is a cation.

pH of the Composition

Traditionally, liquid dishwashing compositions have a pH of about 7. The detergent compositions containing the alkyl amphodicarboxylic acid exhibit improved grease cleaning at both a neutral pH and a more alkaline pH (particularly in soft water conditions). The pH of the composition of the present invention in a 10% solution in water at 20° C. is from about 7 to about 10, more preferably from about 7.5 to about 9.

Dishwashing compositions of the invention will be subjected to acidic stresses created by food soils when put to use, i.e., diluted and applied to soiled dishes. If a composition with a pH greater than 7 is to be most effective in improving performance, it should contain a buffering agent capable of maintaining the alkaline pH in the composition and in dilute solutions, i.e., about 0.1% to 0.4% by weight aqueous solution, of the composition.

The amphocarboxylic acid of the present invention also possesses buffering capabilities; therefore, the use of additional buffers is kept at a minimum. The pKa value of this buffering agent should be about 0.5 to 1.0 pH units below the desired pH value of the composition (determined as described above). Preferably, the pKa value of the buffering agent should be between about 7 and about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and triethanolamine. Other preferred nitrogen-containing buffering agents are 2-amino-2-ethyl-1,3-propanediol, 2-amino-2-methylpropanol, 2-amino-2-methyl-1,3-propanediol, tris-(hydroxymethyl)aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable. The buffering agent is present in the compositions of the invention hereof at a level of from about 0.1% to 15%, preferably from about 1% to 10%, most preferably from about 2% to 8%, by weight of the composition.

Magnesium or Calcium Ions

The presence of magnesium or calcium (divalent) ions greatly improves the cleaning of greasy soils for composition containing the present alkyl amphocarboxylic acid. This is especially true when the compositions are used in softened water that contains few divalent ions. It is believed that divalent ions increase the packing of the present alkyl amphocarboxylic acid at the oil/water interface, thereby reducing interfacial tension and improving grease cleaning.

Furthermore, it has been found that formulating such divalent ion-containing compositions in alkaline pH matrices is difficult due to the incompatibility of the divalent ions with hydroxide ions. When both divalent ions and alkaline pH are combined with the surfactant mixture of this invention, grease cleaning is achieved that is superior to that obtained by either alkaline pH or divalent ions alone.

It has been discovered that compositions of the invention hereof containing magnesium and/or calcium ions exhibit good grease removal, manifest mildness to the skin, and provide good storage stability. The ions are present in the compositions hereof at a level of from about 0.1% to 4%, preferably from about 0.3% to 3.5%, more preferably from about 0.5% to about 2%, by weight of the composition.

Preferably, the magnesium or calcium ions are added as a chloride, acetate, formate or nitrate, preferably a chloride or formate, salt to compositions containing an alkali metal or ammonium salt of the alkyl amphodicarboxylic acid, most preferably the sodium salt, after the composition has been neutralized with a strong base.

Typically, in light duty liquid dishwashing detergent compositions the magnesium and hydroxide ions are incompatible in alkaline compositions resulting in unacceptable levels of precipitates formed during storage of the compositions.

At pH levels between about 9 and 10, although both calcium-containing and magnesium-containing compositions often require chelating agents to prevent precipitate formation. The amount of such chelating agent required for calcium containing compositions is lower than that required for magnesium-containing compositions. Furthermore, at the upper pH range (about 10), compositions containing magnesium ions readily form hydroxide precipitates. The incorporation of weak chelators would avoid such precipitate formation without compromising the grease cleaning benefit provided therefrom. With the use of amphocarboxylic acid, particularly amphodicarboxylic acid, only a small amount, if any, of additional chelator is needed at about pH 10. The chelating abilities of amphocarboxylic acid and its derivatives are attributed to the presence of carboxyl groups in the compound.

Although magnesium may precipitate more readily in alkaline conditions, formulating amphodicarboxylic acid compositions of the present invention containing magnesium ions is easier than that for compositions containing calcium ions. However, calcium can be easily formulated with a monocarboxylated compound.

The amount of magnesium or calcium ions present in compositions of the invention will be dependent upon the amount of total alkyl amphodicarboxylic acid present therein and the amount of anionic co-surfactant. When calcium ions and alkyl amphodicarboxylic acid are present in the compositions of this invention, the molar ratio of calcium ions to total alkyl amphocarboxylic acid is from about 1:8 to about 1:2 for compositions of the invention. For compositions of the present invention comprising magnesium ions, the molar ratio of magnesium ions to total alkyl amphodicarboxylic acid is from about 1:4 to about 1:1.

Co-Surfactants

The compositions of this invention preferably contain certain co-surfactants to aid in the foaming, detergency, and/or mildness.

Included in this category are several anionic surfactants commonly used in liquid or gel dishwashing detergents. The cations associated with these anionic surfactants can be the same as the cations described previously for the alkyl amphodicarboxylic acid. Examples of anionic co-surfactants that are useful in the present invention are the following classes:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $RO-SO_3-M+$ where R is the $C_{8-22}$ alkyl group and M is a mono- and/or divalant cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3-M+$$

where R is a $C_{8-22}$ alkyl group, x is 1-30, and M is a mono- or divalent cation.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1-CH(SO_3-M+)CO_2R_2$$

wherein $R^1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and M+ represents a mono- or divalent cation.

(8) Secondary alcohol sulfates having 6 to 18, preferably 8 to 16 carbon atoms.

(9) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful co-surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

Alkylpolysaccharides are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units.

A suitable alkyl ethoxy carboxylate of the present invention is of the generic formula $RO(CH_2CH_2O)_xCH_2COO-M+$ wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, ammonium, mono-, di-, and tri-ethanol-ammonium, most preferably from sodium, potassium, ammonium, and mixtures thereof with magnesium ions. The preferred alkyl ethoxy carboxylates are those where R is a $C_{12}$ to $C_{14}$ alkyl group.

The uncarboxylated alcohol ethoxylates which may be present in the alkyl ethoxy carboxylate surfactant may be a detriment with respect to the performance benefits provided therefrom.

Therefore, it is an important consideration that the alkyl ethoxy carboxylate-containing surfactant used in this invention contains less than about 10% by weight of the alcohol ethoxylates it is derived from. Although commercially available alkyl ethoxy carboxylates contain 10% or more of alcohol ethoxylates, there are known routes to obtain the desired high purity alkyl ethoxy carboxylates. For example, unreacted alcohol ethoxylates can be removed by steam distillation, U.S. Pat. No. 4,098,818 (Example I), or by recrystallization of the alkyl ethoxy carboxylate, British Pat. No. 1,027,481 (Example 1). Other routes to the desired carboxylates are the reaction of sodium hydroxide or sodium metal and monochloracetic acetic, or its salt, with alcohol ethoxylates under special pressure and temperature combinations, as described in U.S. Pat. Nos. 3,992,443 and 4,098,818; and Japanese Patent Application No. 50-24215, all incorporated herein by reference.

Alternatively, a hindered base, such as potassium tert-butoxide can replace the sodium hydroxide in the above cited patents, thus yielding high purity alkyl ethoxy carboxylates with less stringent temperature and pressure requirements. Specifically, a hindered base of the formula RO−M+, constituting generally an alkyl group, a reactive oxygen center, and a cation selected from the group consisting of akali metals, ammonium, lower alkanol ammonioum ions, and mixtures thereof, is used. The structure of this hindered base is secondary or tertiary and contains a non-linear alkyl group with at least one site of branching within 3 carbon atoms of the reactive center, the oxygen atom, and an alkali metal or alkaline earth metal cation. The process comprises reacting the alcohol ethoxylates with the hindered base described above and either anhydrous chloroacetic acid, at a molar ratio of the hindered base to the anhydrous chloroacetic acid of 2:1, or an alkali metal salt or alkaline earth metal salt of anhydrous chloroacetic acid, at a molar ratio of the hindered base to the alkali metal salt or alkaline earth metal salt of chloroacetic acid of 1:1, wherein the molar ratio of the ethoxylated fatty alcohol to the anhydrous chloroacetic acid or the alkali metal salt or alkaline earth metal salt thereof is from about 1:0.7 to about 1:1.25, the temperature is from about 20° to 140° C., and the pressure is from about 1 to 760 mm Hg.

Other routes to high purity alkyl ethoxy carboxylates are the reaction of alcohol ethoxylate with oxygen in the presence of platinum, palladium, or other noble metals, as disclosed in U.S. Pat. No. 4,223,460 (Example 1-7); U.S. Pat. No. 4,214,101 (Example 1); U.S. Pat. No. 4,348,509; German Patent No. 3,446,561; and Japanese Patent Application No. 62,198,641. One of the by-products of such reactions is soap, which should be limited, as described above, to avoid adversely affecting the cleaning and mildness advantages provided by the present compositions. This can be accomplished by using alcohol ethoxylate feedstock containing low levels of unethoxylated fatty alcohol and by selecting catalysts that preferentially oxidize the terminal methylene in the alcohol ethoxylate, at least about 90% of the time, preferably at least about 95% of the time. Oxidation of non-terminal methylene groups in the alcohol ethoxylate will generate soap from ethoxylated fatty alcohol components.

The cations for the alkyl ethoxy carboxylates herein can be alkali metals, alkaline earth metals, ammonium, and lower alkanol ammonium ions. The source of cations for the alkyl ethoxy carboxylates come from neutralization of the alkyl ethoxy carboxylic acid and from additional ingredients, e.g., performance enhancing divalent ion-containing salts.

Preferred cations for the alkyl ethoxy carboxylate surfactants of the invention are ammonium, sodium, and potassium. For liquid or gel dishwashing detergent compositions having a pH between about 7 and 8, ammonium is most preferred, but at pH levels above about 8, it is undesirable due to the release of small amounts of ammonia gas resulting from deprotonation of the ammonium ions in the composition.

For liquid compositions of the invention containing alkyl ethoxy carboxylate surfactants, potassium is preferred over sodium since it makes the compositions of the invention more resistant to precipitate formation at low temperatures and provides improved solubility to the composition. On the other hand, for gel compositions of the invention, sodium is preferred over potassium since it makes it easier to gel a composition. Mixtures of the cations may be present in any of the compositions of the invention.

Fatty acid amide surfactants having the formula:

$$R^6-\overset{\overset{\displaystyle O}{\|}}{C}-N(R^7)_2$$

wherein $R^6$ is an alkyl group containing from 7 to 21, preferably from 9 to 17, carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

The compositions hereof may also contain a polyhydroxy fatty acid amide surfactant of the structural formula:

$$R^2-\overset{\overset{\displaystyle O}{\|}}{C}-\overset{\overset{\displaystyle R^1}{|}}{N}-Z \qquad \text{(I)}$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')(CHOH)-CH_2OH$, where n is an integer from 3 to 5, inclusive, and R' is H or a cyclic or aliphatic monosaccharide, and alkoxylated derivatives thereof. Most preferred are glycityls wherein n is 4, particularly $-CH_2-(CHOH)_4-CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2-CO-N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In a preferred process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxy-propyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate.

These polyhydroxy "fatty acid" amide materials also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

Other ampholytic surfactants may also be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight-branched chains. One of the aliphatic substituents contains at least 8 carbon atoms, typically from 8 to 18 carbon atoms, and at least one contains an anionic water-solubilizing group, e.g., carboxy, sulfonate, sulfate. See U.S. Pat. No. 3,929,678 to Laughlin et al., issued Dec. 30, 1975, at column 19, lines 18–35 (herein incorporated by reference) for examples of useful ampholytic surfactants.

Zwitterionic surfactants may also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975, at column 19, line 38 through column 22, line 48 (herein incorporated by reference) for examples of useful zwitterionic surfactants.

Such ampholytic and zwitterionic surfactants are generally used in combination with one or more anionic and/or nonionic surfactants.

If included in the compositions of the present invention, these optional additional surfactants are typically present at a concentration of from about 1% to about 15%, preferably from about 2% to about 10% by weight of the composition.

The co-surfactants are present in the composition at a level of from 0% to about 35%, preferably from about 5% to 25%, and most preferably from about 7% to 20%, by weight of the composition.

Suds Booster

Another component which may be included in the composition of this invention is a suds stabilizing surfactant (suds booster) at a level of less than about 15%, preferably from about 0.5% to 12%, more preferably from about 1% to 10% by weight of the composition. Optional suds stabilizing surfactants operable in the instant composition are of five basic types—betaines, ethylene oxide condensates, fatty acid amides, amine oxide semi-polar nonionics, and cationic surfactants.

The composition of this invention can contain betaine detergent surfactants having the general formula:

$$R—N(+)(R^1)_2—R^2COO(-)$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e,g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1—CO—N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are monoethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula $$R_1(C_2H_4O)_nN^{(+)}(R_2)(R_3)\cdots O^{(-)}$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

$$R_1—N^{(+)}(R_2)(R_3)\cdots O^{(-)}$$

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The composition of this invention can also contain certain cationic quarternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting Of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methyl sulfate $C_{8-16}$ alkyl trimethylammonium salts, $C_{8-16}$ alkyl di(hydroxyethyl)-methylammonium salts, the $C_{8-16}$ alkyl hydroxyethyl-dimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

Additional Optional Ingredients

In addition to the ingredients described hereinbefore, the compositions can contain other conventional ingredients suitable for use in liquid or gel dishwashing compositions.

Optional ingredients include drainage promoting ethoxylated nonionic surfactants of the type disclosed in U.S. Pat. No. 4,316,824, Pancheri (Feb. 23, 1982), incorporated herein by reference.

Alcohols, such as $C_1$–$C_4$ monohydric alcohol, preferably ethyl alcohol and propylene glycol, can be utilized in the interests of achieving a desired product phase stability and viscosity. Alcohols such as ethyl alcohol and propylene glycol at a level of from 0% to about 15%, more preferably from about 0.1% to about 10% by weight of the composition are particularly useful in the liquid compositions of the invention.

Gel compositions of the invention normally would not contain alcohols. These gel compositions may contain urea and conventional thickeners at levels from about 10% to about 30% by weight of the composition as gelling agents.

Other desirable ingredients include diluents and solvents. Diluents can be inorganic salts, such as ammonium chloride, sodium chloride, potassium chloride, etc., and the solvents include water, lower molecular weight alcohols, such as ethyl alcohol, isopropyl alcohol, etc. Compositions herein will typically contain up to about 80%, preferably from about 30% to about 70%, most preferably from about 40% to about 65%, of water.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

As used herein, all percentages, parts, and ratios are by weight unless otherwise stated.

The following Examples illustrate the invention and facilitate its understanding.

EXAMPLE I

The following solutions of the present invention are prepared by combining equal moles of amphocarboxylic acid (Miranol®) and calcium or magnesium ions. The composition is evaluated for stability and performance.

| | Moles | | | | | |
|---|---|---|---|---|---|---|
| Components | A | B | C | D | E | F |
| Amphocarboxylic acid[1] | 0.002 | 0.002 | 0.002 | 0.002 | 0.002 | 0.002 |
| Calcium ions (added as $CaCl_2.2H_2O$) | 0.002 | 0.002 | 0.002 | — | — | — |
| Magnesium ions (added as $MgCl_2.6H_2O$) | — | — | — | 0.002 | 0.002 | 0.002 |
| pH | 7 | 8 | 9 | 7 | 8 | 9 |

[1]Miranol ® C2M, cocoamphodiacetate from Miranol, Dayton, N.J.

Grease removal is assessed by measuring interfacial tension (IFT) at the oil/water interface. IFT is a measure of the amount of energy needed to emulsify grease. The lower the number, the better the grease cleaning ability of the product. IFT is determined using a University of Texas Model 500 Spinning Drop Interfacial Tension meter under conditions representative of those encountered by consumers using light-duty liquid or gel dishwashing detergent. Thus, measurements are made at a sample temperature of 115° F. (46.1° C.) using a product concentration of 0.2% in 0–15 grain water. The soil is animal fat. A narrow capillary tube is filled with solution of the composition and a drop of the melted animal fat is carefully added via a syringe. An IFT reading is taken immediately upon insertion of the sample into the tensionmeter and again at five and ten minutes.

The above magnesium formulation give excellent combinations of grease cleaning and mildness and are stable to storage at elevated temperatures (up to 120° F.). The grease cleaning provided by magnesium compositions at a pH of about 7 to about 9 is better than that provided by a similar composition containing an equivalent (molar basis) amount of calcium ions.

EXAMPLE II

The following liquid compositions of the present invention are prepared according to Example I except that the amphocarboxylic acid and calcium or magnesium ions are combined in a different molar ratio (2:1).

| Components | Moles | | | | | |
|---|---|---|---|---|---|---|
| | A | B | C | D | E | F |
| Amphocarboxylic acid[1] | 0.002 | 0.002 | 0.002 | 0.002 | 0.002 | 0.002 |
| Calcium ions (added as $CaCl_2.2H_2O$) | 0.001 | 0.001 | 0.001 | — | — | — |
| Magnesium ions (added as $MgCl_2.6H_2O$) | — | — | — | 0.001 | 0.001 | 0.001 |
| pH | 7 | 8 | 9 | 7 | 8 | 9 |

[1]Miranol ® C2M, cocoamphodiacetate from Miranol, Dayton, N.J.

The above formulations give excellent combinations of grease cleaning and mildness and are stable at elevated temperatures (up to 120° F.). The grease cleaning provided by magnesium compositions at a pH of about 7 to about 9 is better than that provided by a similar composition containing an equivalent (molar basis) amount of calcium ions. Calcium ions are more effective in the composition at lower levels.

EXAMPLE III

The following liquid compositions of the present invention are prepared according to the description set forth below. The alkyl amphodicarboxylic acid is combined with any co-surfactant and optional ingredients such as suds boosters, buffer, ethanol, and hydrotrope. The pH is adjusted with sodium hydroxide or hydrochloric acid to about 8.5 and magnesium or calcium ions are added in the form of a (n) chloride, acetate, formate and/or sulfate salt.

| Component | % By Weight | | |
|---|---|---|---|
| | A | B | C |
| Sodium $C_{12-13}$ alkyl ethoxy (ave 1) sulfate | 10 | 20 | 22.5 |
| Amphocarboxylic acid[1] | 18 | 9 | 6 |
| $C_{11}$ alkyl ethoxy (9 ave.) alcohol | 2.5 | 2.5 | 2 |
| $C_{12/13}$ alkyl amine oxide | 2 | 3 | 2 |
| $C_{12-14}$ alkylamidopropylbetaine | 0.5 | 0.5 | 0.5 |
| Sodium chloride | 0.5 | 0.5 | 0.5 |
| Magnesium ions | 1.4 | 1.1 | 1.1 |
| Ethanol | 7 | 7 | 7 |
| Water and minors | | balance | |
| pH (10% solution) | 8.5 | 8.5 | 8.5 |

[1]Miranol ® C2M, cocoamphodiacetate from Miranol, Dayton, N.J.

These formulations of the present invention provide both good dilute solution grease cleaning, suds mileage and formulation storage stability at elevated temperatures of 120° F.

What is claimed is:

1. A liquid or gel liquid detergent composition comprising, by weight of the composition:

(a) from about 5% to about 95% of an alkyl amphocarboxylic acid of the general formula:

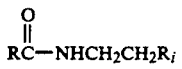

wherein R is a $C_8$–$C_{18}$ alkyl group, and $R_i$ is of the general formula

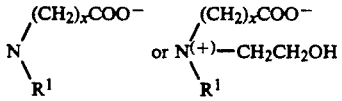

wherein $R^1$ is a $(CH_2)_xCOOM$ or $CH_2CH_2OH$, and x is 1 or 2 and M is a cation;

(b) from about 0.1% to about 4% of calcium or magnesium ions; and (c) from about 40% to about 55% of water;

wherein said composition has a pH in a 10% solution in water at 20° C. of between about 7 and about 10.

2. A composition according to claim 1 wherein said $R_i$ in (a) is

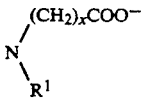

wherein $R^1$ is a $(CH_2)_x$ COOM or $CH_2CH_2OH$, x is 1 or 2 and M is a cation.

3. A composition according to claim 2 comprising from about 0.3% to about 3.5% of said calcium or magnesium ions and having a pH in a 10% solution in water at 20° C. of between about 7.5 and about 9.

4. A composition according to claim 3 wherein R in (a) is a $C_{10}$ to $C_{14}$ alkyl group.

5. A composition according to claim 4 wherein said calcium or magnesium ions are added to said composition as a salt selected from the group consisting of chloride, acetate, formate, nitrate and mixtures thereof.

6. A composition according to claim 5 further comprising from about 5% to about 35% of a co-surfactant selected from the group consisting of alkyl sulfate; alkyl ether sulfate; polyethercarboxylate; secondary olefin sulfonates; sarcosinates; methyl ester sulphonates; alkylglycerol ether sulphonates; polyethylene; polypropylene and polybutylene oxide condensates of alkyl phenols; the alkyl ethoxylate condensation products of aliphatic alcohols with ethylene oxide; the condensation products of ethylene oxide with a hydrophobic base formed by condensation of propylene oxide with propylene glycol; the condensation product of ethylene oxide with the product resulting from the reaction of propylene oxide and ethylenediamine; alkylpolysaccharides; fatty acid amides; alkyl ethoxy carboxylates; polyhydroxy fatty acid amides and mixtures thereof.

7. A composition according to claim 6 comprising from about 0.5% to about 2% of magnesium or calcium ions and wherein $R^1$ is $(CH_2)_xCOOM$.

8. A composition according to claim 6 further comprising less than about 15% of a suds booster selected from the group consisting of betaines, ethylene oxide condensates, fatty acid amides, amine oxide semi-polar nonionics, cationic surfactants and mixtures thereof.

9. A composition according to claim 8 comprising magnesium ions having a molar ratio of magnesium ions to alkyl amphocarboxylic acid from about 1:4 to about 1:1.

10. A composition according to claim 9 wherein said magnesium ions are added as chloride salts.

11. A composition according to claim 8 comprising calcium ions and having a molar ratio of calcium ions to alkyl amphocarboxylic acid from about 1:8 to about 1:2.

12. A composition according to claim 11 wherein said calcium ions are added as chloride or formate salts.

13. A composition according to claim 6 comprising from about 0.5% to about 2% of calcium ions and wherein $R^1$ is $CH_2CH_2OH$.

14. A composition according to claim 13 wherein said calcium ions are added as chloride or formate salts.

15. A liquid detergent composition according to claim 14 further comprising less than about 15% of a suds booster selected from the group consisting of betaines, ethylene oxide condensates, fatty acid amides, amine oxide semi-polar nonionics, cationic surfactants, and mixtures thereof.

16. A liquid detergent composition according to claim 15 comprising a molar ratio of calcium ions to alkyl amphocarboxylic acid from about 1:8 to about 1:2.

17. A liquid detergent composition according to claim 8 comprising from about 5% to about 60% of said alkyl amphocarboxylic acid and further comprising from about 0.1% to 10% of $C_1$–$C_4$ monohydric alcohols.

18. A liquid detergent composition according to claim 17 wherein said $C_1$–$C_4$ monohydric alcohol is ethyl alcohol or propylene glycol.

19. A liquid detergent composition according to claim 18 comprising magnesium ions and having a molar ratio of magnesium ions to alkyl amphocarboxylic acid from about 1:4 to about 1:1.

20. A gel detergent composition according to claim 8 comprising from about 10% to about 45% of said alkyl amphocarboxylic acid.

* * * * *